US005676842A

United States Patent [19]

Bedi et al.

[11] Patent Number: 5,676,842

[45] **Date of Patent: *Oct. 14, 1997**

[54] INTEGRAL OR FILTER MOUNT AND METHOD OF CHANGING OIL

[75] Inventors: Ram D. Bedi; Adrianus J. van der Griendt, both of Bloomfield Hills, Mich.

[73] Assignee: K. J. Manufacturing Co., Wixon, Mich.

[ * ] Notice: The term of this patent shall not extend beyond the expiration date of Pat. No. 5,526,782.

[21] Appl. No.: 511,742

[22] Filed: Aug. 7, 1995

[51] Int. Cl.[6] ..... B01D 35/14; F16N 31/00; F16N 39/06

[52] U.S. Cl. ..... 210/739; 123/196 A; 184/15; 184/108; 210/91; 210/168; 210/171

[58] Field of Search ..... 184/1.5, 106, 108, 184/109; 123/196 R, 196 A, 196.7; 210/85, 91, 94, 143, 168, 171, 282, 739, 767, 805, DIG. 17, 248

[56] References Cited

U.S. PATENT DOCUMENTS

| | | | |
|---|---|---|---|
| 1,584,505 | 5/1926 | Bevins | 184/1.5 |
| 2,320,048 | 5/1943 | Parson . | |
| 3,197,029 | 7/1965 | Yelinek et al. | 210/DIG. 17 |
| 3,557,767 | 1/1971 | Green . | |
| 3,871,483 | 3/1975 | Espinosa et al. | 184/1.5 |
| 4,086,981 | 5/1978 | Mitsui | 184/1.5 |
| 4,172,738 | 10/1979 | Woltjen | 184/1.5 |
| 4,592,448 | 6/1986 | Morris | 184/1.5 |
| 4,745,894 | 5/1988 | Laipply et al. | 123/196 R |
| 4,865,156 | 9/1989 | Poung | 184/1.5 |
| 4,951,784 | 8/1990 | Bedi | 184/1.5 |
| 4,964,373 | 10/1990 | Bedi | 123/196 R |
| 4,977,928 | 12/1990 | Smith et al. | 137/596 |
| 4,977,978 | 12/1990 | Batrice | 184/1.5 |
| 5,044,334 | 9/1991 | Bedi | 123/196 R |
| 5,061,379 | 10/1991 | White | 210/91 |
| 5,062,398 | 11/1991 | Bedi et al. | 123/196 R |
| 5,090,376 | 2/1992 | Bedi | 123/196 R |
| 5,094,201 | 3/1992 | Bedi | 123/196 R |
| 5,154,775 | 10/1992 | Bedi | 134/22.1 |
| 5,168,844 | 12/1992 | Waelput | 123/196 A |
| 5,192,424 | 3/1993 | Beyne et al. | 210/91 |
| 5,209,198 | 5/1993 | Bedi | 123/196 R |
| 5,236,064 | 8/1993 | Wagoner | 184/6.3 |
| 5,246,086 | 9/1993 | Yunick | 184/1.5 |
| 5,263,445 | 11/1993 | Bedi et al. | 123/196 S |
| 5,443,138 | 8/1995 | Bedi et al. | 123/196 R |
| 5,452,695 | 9/1995 | Bedi | 123/196 A |
| 5,454,355 | 10/1995 | Van Der Griendt | 184/1.5 |
| 5,487,447 | 1/1996 | Martinez Velazquez | 123/196 R |
| 5,526,782 | 6/1996 | Bedi et al. | 123/196 A |

*Primary Examiner*—Joseph W. Drodge
*Attorney, Agent, or Firm*—Young & Basile, P.C.

[57] ABSTRACT

A method and device for changing oil and measuring oil consumption in an internal combustion engine having an internal oil lubrication distribution passage system with an oil filter and oil reservoir including a pump and receptacle for evacuating fluid from the oil reservoir, a pump and receptacle with a fresh oil supply for introducing into the oil reservoir through the oil filter and internal oil lubrication system. An electronic module on the vehicle and communicating and recording with the device facilitates the oil changing process in an easy and safe manner by communicating pertinent information to the device for changing oil including signal to the device an engine running condition and an oil filter-securely-in-place condition so that the device deactivates when the engine is running and the oil filter is not securely in place. The engine includes two ports machined into the engine block one in fluid communication with the inlet side of the oil filter, and the other in fluid communication with the bottom of oil reservoir via internally cast passages and an oil drain line.

18 Claims, 2 Drawing Sheets

INTEGRAL OR FILTER MOUNT AND METHOD OF CHANGING OIL

BACKGROUND OF THE INVENTION

1. Field of the Invention

The invention relates to a apparatus and method for changing motor oil in an internal combustion engine having an oil pan or similar oil reservoir. Such reservoirs can be found in automobiles, trucks, tractors, heavy earth moving equipment, military equipment, or the like. More particularly, this invention relates to an apparatus and method in which introduction of engine oil can be accomplished at a location through the engine adjacent to the engine oil filter unit. More particularly, this invention relates to methods in which spent or dirty oil is expediently removed from the oil pan and analyzed as to amount and condition, and then the lubrication system crankcase and oil pan are refilled with a measured amount of fresh oil appropriate for the engine.

2. Background of the Relevant Art

The benefits of routine oil changes in an internal combustion engine are well known. Routine oil changes have been shown to increase engine life and performance. With repeated prolonged use, motor oil builds up suspended particles, metallic and non-metallic, from the abrasive and adhesive wear of engine parts against one another and from products of incomplete combustion and improper air intake. The particles in turn cause abrasive wear of the engine bearings, piston rings and other moving parts and the reduction of the motor oil lubricity as various additives and lubricating components become depleted. This adversely affects engine performance and if left unchanged can destroy or cripple the engine performance. It is recommended by at least one oil manufacturer that the level of total solid concentration be limited to levels below 3.0% with levels of silica being present in amounts lower than 25 parts per million and sodium in amounts lower than 200 parts per million.

To obtain satisfactory engine performance, and maintain solids concentration levels in the motor oil lower than the recommended 3.0%, changing the motor oil in an internal combustion engine is a necessary, but an inconvenient, dirty and time-consuming task. In currently designed vehicles, the oil pan serves the purpose of a reservoir for circulation of engine oil. Engine lubrication is generally accomplished through a gear-type pump. The pump picks up engine oil from the oil pan sump, where oil is drawn up through the pick-up screen and tube, and passed through the pump to the oil filter. The oil filter is generally a full flow paper element unit. In some vehicles, an oil filter bypass is used to insure adequate oil supply, should the filter become plugged or develop excessive pressure drop. Oil is routed from the filter to the main oil gallery. The oil gallery supplies valve train components with oil, and by means of intersecting passages, supplies oil to the cam shaft bearings. Oil draining back from the rocker arms is directed, by cast dams in the crank case casting, to supply the cam shaft lobes. Oil also drains past specific hydraulic lifter flats to oil cam shaft lobes directly. The passages supplying oil to the cam shaft bearings also supply the crank shaft main bearings through intersecting passages. Oil from the crank shaft main bearings is supplied to the connecting rod bearings by means of intersecting passages in the crank shaft. The front cam bearing can include a slot on its outside diameter to supply oil to the cam sprocket thrust face. In some engines, many internal engine parts have no direct oil feed and are supplied either by gravity or splash from other direct feed components. A bypass valve can also be disposed in the oil pick-up screen to insure adequate oil flow if the screen should become restricted. A pressure regulator valve, sometimes located in the oil pump body, maintains adequate pressure for the lubrication system and bypasses any excess back to the suction side of the pump. Oil from the pump passes through the filter before going to the engine oil galleries. In the filter, the oil passes through a filtering element where dirt and foreign particles are removed.

To remove the contaminated oil, the drain plug, generally located in the suitable portion of the oil pan, is opened. The spent oil containing suspended particles is permitted to flow under gravity out of the pan into a suitable receptacle. After the spent oil is removed, the plug is replaced and fresh oil is added to the engine usually through a separate opening in the engine valve cover. The process of gravity drainage does not remove all of the spent oil from the oil galleries with its metallic and non-metallic particulates which remain stuck to the gallery walls, as well as engine components such as the crank shaft, connecting rods, pistons and the like which are exposed to the motor oil spray lubrication. These particles remain to be mixed with fresh motor oil. Thus the concentration of contaminants is not completely eliminated.

The oil change process is essentially the same whether performed at home, at service stations or at one of the various oil change centers which have opened in recent years. The flow rate, or time required for oil drainage, is the same for each of these locations, because it is limited by the size of the drain plug aperture and the force of gravity. Service stations and other locations simplify the process of oil drainage with the use of hydraulic racks, special oil collection receptacles and the like. However, this specialized and expensive equipment is not readily available to the typical automotive owner who may wish to change the oil in his vehicle. It has been estimated that the retail market of oil is approximately 2.83 billion quarts or approximately 700 million gallons. The do-it-yourself individual has been found to be price sensitive, and tends to distrust the quality of service stations and other oil change centers. The do-it-yourself individual typically believes that if you want a job done right, you do it yourself. However, the current design of vehicles does not lend itself to do-it-yourself oil changes in a convenient clean and effortless manner. Many vehicles have low ground clearance making it difficult to access the oil drain plug for removal of the spent oil, and also making it difficult to collect the oil without contaminating the surrounding environment.

Regardless of the manner in which oil change is accomplished, it has long been appreciated that engine oil consumption can be indicative of engine performance and general engine condition. Excessive oil consumption can be indicative of engine problems such as malfunctioning piston rings, leaking and sagging exterior gaskets and seals or a lack of integrity in seals between the oil passages and coolant system. Information about specific increases in oil consumption would be of value to the vehicle owner to assist him in scheduling appropriate engine maintenance and repair before minor engine problems become major mechanical failures which compromise engine performance and engine life and introduce engine oil contaminants to be environment either as products of combustion or as leakage which can indiscriminately contaminate surfaces of the exterior engine compartment, as well as road and garage surfaces.

Environmental protection is a prominent social issue in our present society. Therefore, it would be desirable to encourage that all oil changes be performed in the most environmentally safe manner possible. It is estimated that there are approximately 119 million privately owned passenger vehicles. These vehicles require approximately 360 million oil changes a year, using an average of 1.2 gallons per change based on an average oil change frequency of 2.94 times a year. This amounts to approximately 550 million gallons of motor oil changed per year. Of this amount, it is estimated that 70% of motor oil is installed by motorists themselves. It is believed that pursuant to present practice, the spent oil drained by motorists finds its way into spent household containers, such as milk cartons and the like. The household containers are closed and disposed of in the garbage which can and will finally find its way into the local waste dump. As the household container deteriorates, the oil and its contaminates will eventually seep into the surrounding ground and any ground water below the dump site. It has been estimated that 300 million gallons of oil a year seep into U.S. soil creating serious potential ground water pollution problems. It would be desirable environmentally and economically if this oil could be collected and recycled. In order to motivate the do-it-yourself market, it is desirable in the present invention to make the collection of oil during oil changes quick, effortless, clean and inexpensive.

In establishing a system for encouraging oil recycling and resource recovery, it is also highly desirable to provide an oil change system which is self-documenting. By this, it is meant that the system is capable of accurately measuring and recording the amount of spent oil removed from various engines and the amount of fresh oil introduced into these engines. Accurate records of the amount of spent oil collected can be valuable in producing any waste manifests required under existing environmental protection and/or resource recovery laws.

Such records would provide regulatory agencies with an accurate indication of an oil handler's compliance with existing laws. The records would also be valuable to the operator of any oil change service by providing him with documentation demonstrating his adherence to all applicable laws and an opportunity to assist his customers in evaluating the need for overall engine maintenance.

Conservation of energy and the trade deficit are also major issues in today's society. It is estimated that 225–250 million gallons of spent oil can now be easily collected and profitably recycled. The price of spent oil so collected is four dollars per barrel at best, while the price of crude oil is much greater at approximately $18.00 per barrel. Recycling easily collected spent oil could decrease the trade deficit by approximately 80–100 million dollars, while providing a profitable recycling economy of approximately 75 million dollars per year.

Therefore, it would be desirable to provide a method which accelerates removal of spent oil completely and easily from the crank case. It would also be desirable to provide a system which reduces the amount of spent oil handling as required in the conventional oil change service station. It would also be desirable to provide a system which permits accurate assessment of the amount of oil expended and recovered. Finally, it is desirable to provide a method which could be easily employed by all vehicle owners at a convenient location with all the benefits of the method of the present invention such as time savings, money savings, convenience, minimum exposure to motor oil, environmental protection, energy conservation, trade deficit reduction, and finally longer lasting, better performing engines.

SUMMARY OF THE INVENTION

The present invention includes an apparatus external and separable from the internal combustion engine. The external device would be operably connectible to fresh oil storage means and waste oil storage means. The external apparatus preferably includes air purge means for purging fluid retained within the oil filter element and any fluid remaining in the lubrication system passages of the internal combustion engine, such that all waste fluid would be deposited within the oil pan reservoir. The pump means of the external apparatus draws waste fluid from the oil pan reservoir for deposit in the appropriate waste storage or disposal device.

The present invention further includes safety features and means to obtain vehicle information for the external apparatus via a vehicle electronic module to facilitate the oil change process and to deactivate the oil changing process under certain conditions. The safety features may include a signal to the external apparatus via the vehicle electronic module whether or not the oil filter is securely in place. If the oil filter is not securely in place, the external apparatus will not activate the purge air or oil filling process. Another safety feature provides a signal to the external apparatus via the vehicle electronic module whether or not there is oil pressure present indicating that the engine is running. If a signal indicates that the engine is running, the external apparatus will not proceed with the oil changing process until it is confirmed that there is no oil pressure present. An alert to the user will also be provided indicating an engine-running condition, so that the user will turn off the engine in order to proceed with the oil changing process.

In addition, the external apparatus may include means for obtaining and updating vehicle and engine information that facilitates the oil change process. Information relating to the vehicle, such as vehicle I.D., the capacity of the oil reservoir, as well as history of previous oil changes can be recorded in the vehicle electronic module. Connection of the vehicle to the external apparatus allows a computer in the external apparatus to read as well as update or change this information in the vehicle electronic module. This vehicle information accelerates the oil change process by eliminating manual entries as well as potential errors during the manual entries.

The present invention further includes a modification to the engine block whereby a filter mounting boss is located at an easily accessible place, such as on top of the engine, preferably towards the front so as to make it easily reachable. The boss is similar to most existing filter mounting bosses for spin on filters, with the exception that it is located near the top rather than at or near the bottom or the side of the engine. In addition, two ports are machined into the engine block. A first port has fluid communication to the inlet (unfiltered) side of the oil filter, and the second port is in communication with the bottom of the oil pan via internally cast passages and an oil drain suction tube. These two ports may be used to install a quick connect fitting for easy connection to the external oil changing apparatus by way of correspondingly mating quick connect couplers.

In operation, the present invention provides a method for quickly and efficiently removing, measuring and recording the amount of waste oil present in an internal combustion engine, replenishing the lubrication system of an internal combustion engine with an appropriate, measured amount of fresh oil. Additionally, the present invention provides purging of fluid from the oil filter element of the internal combustion engine with pressurized air means. Furthermore, all fluids introduced in the internal combustion engine first flows through the oil filter element of the internal combustion engine and then passes through the lubrication passages within the internal combustion engine prior to accumulating within the oil pan reservoir of the internal combustion engine. Except for the quick connect fittings, all connections are internal to the engine block, thereby eliminating any associated leak paths.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
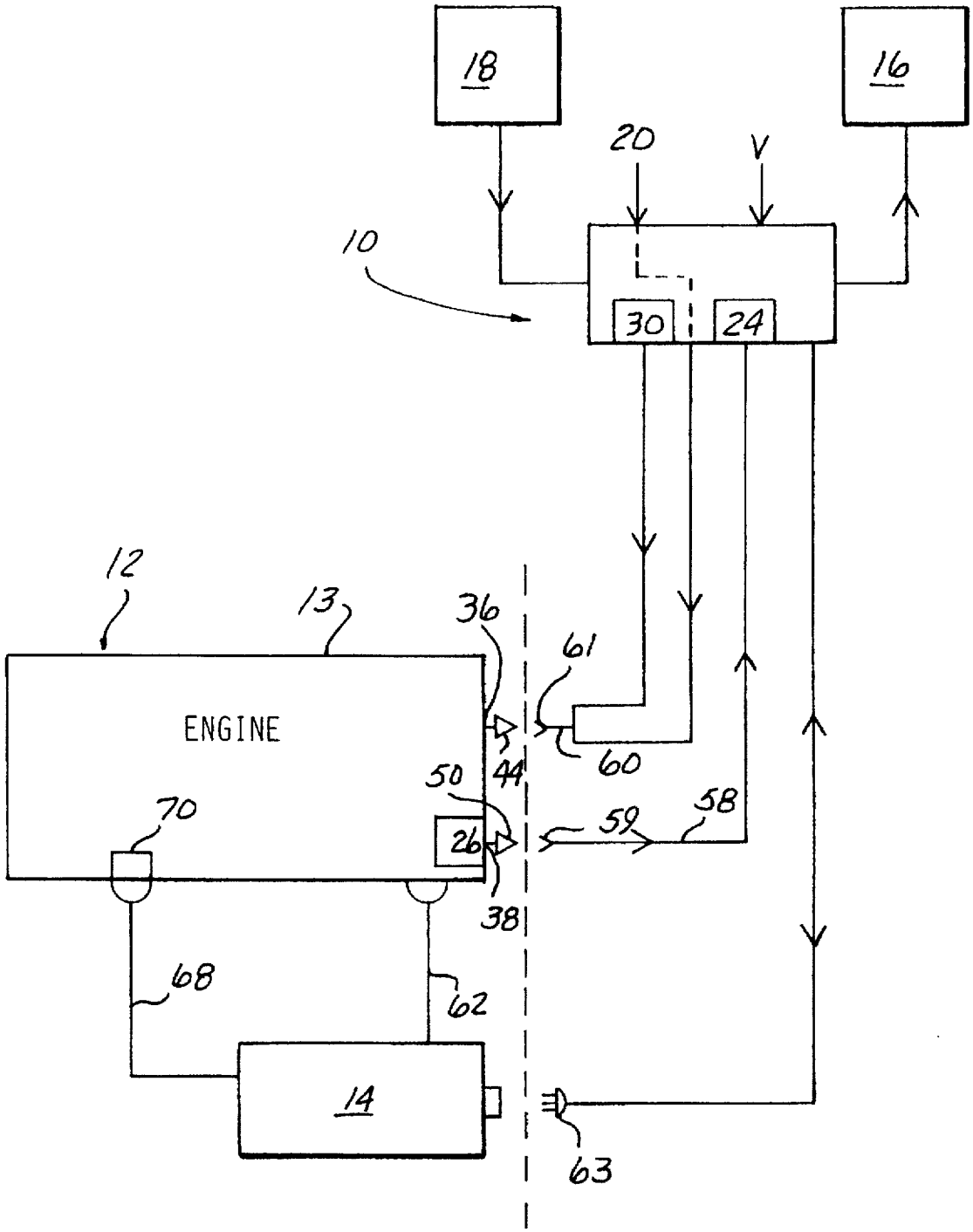
FIG. 1 is a schematic view of an oil change apparatus connected to an associated internal combustion engine according to the present invention.

The apparatus of the present invention is depicted schematically in FIG. 1 and includes the embodiments of the internal combustion engine shown in FIGS. 2–5.

With reference to FIG. 1, the present invention includes an oil changing apparatus, generally designated as 10, which is separable from an internal combustion engine generally designated as 12. The internal combustion engine 12 has an on-board electronic module 14 having a memory chip and sensors for storing relevant information for facilitating the oil change process. Such sensors may include an oil pressure signal, a signal indicating that an oil filter is in place. The memory chip may store various vehicle information including a vehicle I.D., engine oil capacity, and an oil change history. It is understood that the memory chip of the electronic module 14 may store all or some of the above listed items as well as other items that may be deemed important in the future. When the oil changing apparatus is fluidly connected to the lubrication system in the internal combustion engine, an electrical connection is also provided to the vehicle electronic module for reading and updating the aforementioned vehicle information.

The oil changing apparatus 10 of the present invention is connectible to external storage means. Storage means may include a waste oil storage receptacle 16 and a fresh motor oil supply receptacle 18. The oil changing apparatus 10 also includes a connection to a source of compressed air 20, such as a pump. Connection to the source of compressed air is controlled by appropriate valve means (not shown), for opening and closing the communication of the compressed air 20 with the oil changing apparatus 10. Of course, it is recognized that the pressure of which the compressed air 20 supplied to the oil changing apparatus 10 must be controlled so that excessive pressure is not delivered to the internal oil lubrication distribution passage system is no more than the pressure of the oil pump 22, shown in FIGS. 2 and 5, of the internal combustion engine. It should be recognized that the appropriate control circuitry for regulating pressure is also provided. The compressed air is well known to those skilled in the art of compressed air delivery systems and is commercially available. It should also be noted that the compressed air 20 delivered to the internal oil lubrication distribution passage system should be clean and dry so that minimal or no water vapor is introduced in the internal oil lubrication distribution passage system which could thereby cause problems with rust and degradation of the oil to be introduced into the internal oil distribution passage system of the internal combustion system.

Figure 2:
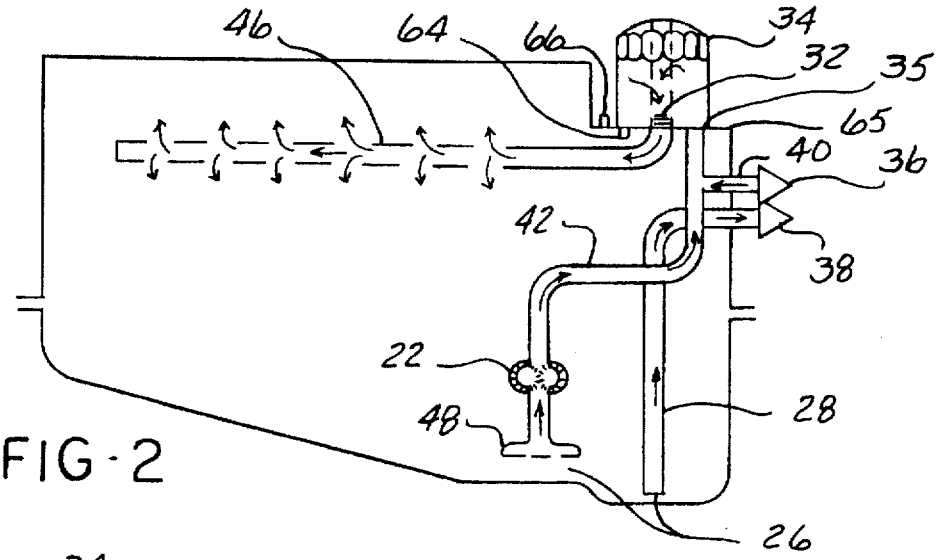
FIG. 2 is a side view of an internal combustion engine showing one embodiment of the internal connections for an external oil changing apparatus.

As depicted schematically in FIGS. 1 and 2, the pump means may include a first pump 24 for drawing spent oil from the oil reservoir 26 through the drain line 28 of the internal combustion engine for discharge into the waste oil storage means. Pump means may also include a second pump 30 for introducing fresh motor oil from the fresh motor oil storage receptacle 18 into the internal oil lubrication distribution passage system of the internal combustion engine 12.

Modification to the engine block 13 are shown according to the present invention in FIGS. 2–5, whereby a filter mounting boss 32 is located on top of the engine, preferably towards the front so as to make it easily accessible. The modification to the engine block 13 provide the benefits of an improved and convenient oil change method while eliminating the disadvantages of creating additional potential leak paths, additional expense in parts and assembly, and additional challenges in packaging the devices on the engine in limited engine space as provided by previous remote oil filter adapters. The boss 32 is similar to most existing filter mounting bosses for spin on filters, with the exception that the boss is located on top rather than at or near the bottom and side of the engine 12. The configuration places the oil filter 34 in an upside down position to achieve a more complete emptying of the oil filter 34 in the oil change process that uses purged air. The oil filter 34 will preferably include an anti-drain valve (not shown) to prevent the oil, from draining out of the filter 34 when the engine 12 is not running, but allowing for complete evacuation of the oil in the filter 34 having purge air.

In addition, two ports are machined into the engine block. One of the ports 36 is for fluid communication to the inlet (unfiltered) side of the oil filter 34, and the other port 38 is in fluid communication with the bottom of the oil reservoir/pan 26 via internal cast passages and oil drain suction tube. These two ports may be used to install the quick connect fitting as mentioned previously, and are located so as to easily make connections to the external oil change equipment 10 via the mating quick connect couplers.

Figure 3:
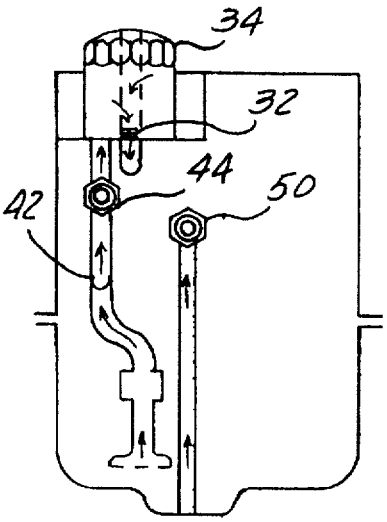
FIG. 3 is a front view of the internal combustion engine in FIG. 2.

FIGS. 2 and 3 show one embodiment for the internal cast passages for oil communication throughout the internal combustion engine 12. The first port 36 opens to a branch passage 40 that connects with a main passage 42 leading from the oil reservoir 26 to the inlet (unfiltered) side of the oil filter. The first port 36 has a quick connect fitting 44 which includes a check valve that prevents flow through the port 36 unless quick connect fitting is connected to a mating external coupling 61, shown in FIG. 1. The connection to quick connect fitting 44 may be used to send in purge air to evacuate oil out of the oil filter 34 and the oil passages into the oil reservoir 26, thereby removing oil that would not normally drain during a conventional oil process. The connection 44 may also be used to introduce fresh oil into the engine. The oil introduction procedure fills the oil filter 34 first after which the filtered oil enters the oil passages, as represented at 46, under pressure. As a result, instant oil pressure and lubrication during engine start up is achieved. During normal engine running operation, the oil in oil reservoir 26 is drawn through a screened inlet 48 and into the oil pump 22. From there the oil is pushed through main passage 42 into the inlet 35 of oil filter 34. The oil is filtered and passes to the oil passages 46 after which the oil returns by gravity to the oil reservoir 26, completing the circuit.

A second port 38 opens to a passage 28 which is a drain line from the oil reservoir 26 providing fluid communication with the bottom of the oil reservoir 26. The second port 38 has quick connect fitting 50 that may be used to remove oil from the oil reservoir 26 by applying suction by the external oil exchange apparatus 10. This procedure may be a separate function or be done in conjunction with the air purge process.

Figure 4:
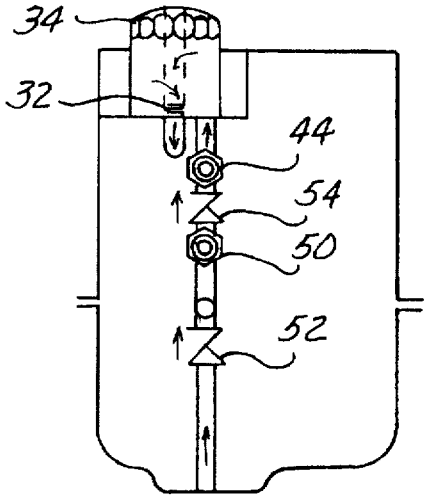
FIG. 4 is a second embodiment of an internal combustion engine showing the internal connections for an external oil changing apparatus.
Figure 5:
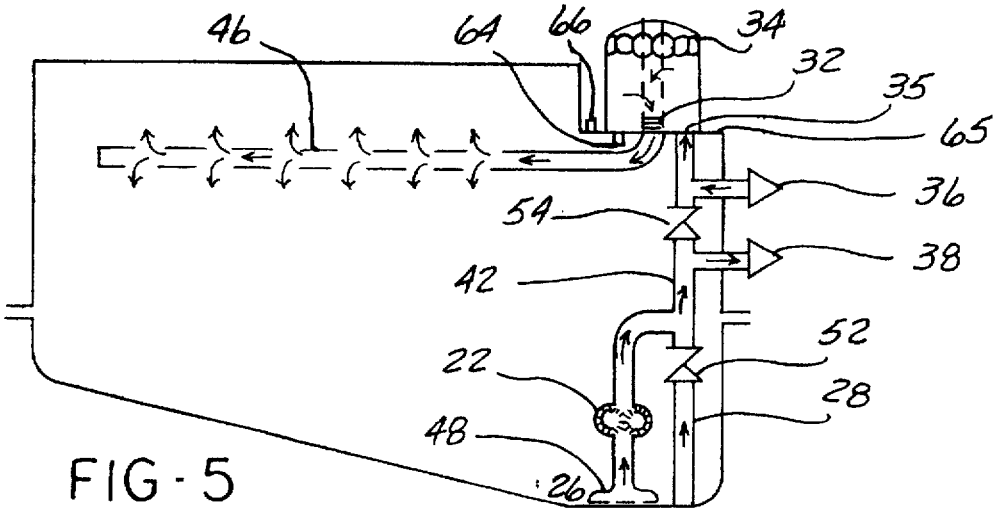
FIG. 5 is a front view of the internal combustion engine of FIG. 4.

FIGS. 4 and 5 shown an alternative embodiment similar to the previous embodiment except that the oil drain suction line 28 is directly connected to the oil pump 22 outlet line. A check valve 52 is positioned in the oil drain line 28 prior to its connection to the oil pump outlet line that proceeds to the inlet of the oil filter. Check valve 52 prevents oil passing through screened inlet 48 and oil pump 22 into the oil pump outlet line from flowing back into the oil reservoir via oil drain line 28. A second check valve 54 is disposed in main passage 42 between the branch passage 40 and evacuation branch passage which communicates to second port 38. Second check valve 54 ensures that there is no other flow than from the bottom of the oil reservoir 26 through the oil drain line 28 and check valve 52. Similarly, to the embodiment shown in FIGS. 2 and 3, first and second port 36 and 38 have quick connect fittings 44 and 50 respectively which include check valves which prevent flow through the ports, unless the respective quick connect fittings are connected to corresponding external couplings 61 and 59 respectively.

In operation, the internal combustion engine 12 is brought into proximity with the oil changing apparatus 10. The fluid conduit hose 58 from the oil exchange apparatus 10 having a first quick connect coupling 59 is connected to the oil drain connection 50 on the engine block. The oil drain connection 50 is fluidly connected to the oil reservoir 26 of the internal combustion engine 12. Another hose 60 with a second quick connect coupling 61 from the oil exchange apparatus 10 is connected to the filter inlet connection 44 connected to the internal combustion engine for introducing compressed air and fluid into the internal combustion engine 12 through the filter element 34 and finally into the internal oil lubrication distribution passage system of the internal combustion engine for subsequent accumulation in the oil pan reservoir 26. The oil exchange apparatus 10 is connected to an electrical energy outlet V as well as connected to the vehicle electronic module 14 at 63 for access to vehicle information and safety information.

The oil exchange apparatus 10 is activated upon initial start-up by reading information from the vehicle electronic module 14 regarding the vehicle, so that the oil change process is facilitated. Such information could include a vehicle I.D., the capacity of the oil reservoir 26, and a history of previous oil changes. Other pertinent information may also be read as needed. In addition, the oil exchange apparatus also reads various signals for safety reasons. One such signal is the "oil filter securely in place" signal 62. The "oil filter in place" signal tells the oil exchange apparatus 10 whether or not the oil filter 34 is in place. If the oil filter 34 is not in place, the oil exchange apparatus 10 will not activate the purge air or new oil filling process. The "oil filter securely in place" signal 62 could be generated preferably by a microswitch 64 embedded in the oil filter mounting face 65 of the engine block such that when the oil filter 34 is installed onto the base of the oil filter mounting face 65 the oil filter 34 would press against the switch 64 which would close contact and thereby providing a signal 62 that the oil filter 34 is securely in place. When the oil filter 34 is removed from the oil mounting face 65, the switch would open and thereby sending a signal 62 that there is no filter connection and deactivate the oil exchange apparatus 10 such that no air or oil can be introduced into the internal combustion engine. Alternatively, a signal could be generated by a proximity switch 66, installed near the oil filter 34 which would sense the presence or absence of the filter 34 and thereby providing a similar signal to the oil exchanger 10.

An additional safety feature is provided by an oil pressure signal 68. The oil pressure signal 68 notifies the oil exchange apparatus 10 whether or not there is oil pressure present. When oil pressure is present, the internal combustion engine 12 is running. When the oil pressure signal 68 is activated, the oil exchange apparatus remains deactivated and the user will be alerted to stop the engine. The oil exchanger will not proceed until the engine is stopped and confirmed by the oil pressure signal 68. The oil pressure signal 68 protects the engine from running without oil in the lubrication passages 46. The oil pressure signal 68 may be generated by a pressure sensing device 70 installed on the vehicle, or the signal may be taken from an oil pressure sensor already present on the engine. Once the oil exchanger has determined that the oil filter 34 is in place, the engine 12 is not running and has read and recorded the various pertinent information, the oil exchange apparatus 10 may proceed with the oil changing system. The oil exchange apparatus introduces pressurized air 20 into the system to purge fluid from the oil filter element 34 thereby causing the residual spent oil retained within the oil filter 34 to be discharged through the internal oil lubrication distribution passage system to the oil pan reservoir 26 of the internal combustion engine 12. The air enters through filter inlet connection 44 and passes through passage 42 through the filter 34, and into passages 46 leading to the internal oil distribution passage system of the internal combustion engine 22.

During the purging operation, a pump 24 is energized to draw fluid from the oil reservoir 26 through the drain line 28 of the internal combustion engine and through fluid connection 50 for discharge into the spent oil storage receptacle 16. After the oil reservoir 26 of the internal combustion engine has been emptied, the air introduction is deactivated to stop delivery of the compressed air 20 and the pump 24 is deenergized. The empty oil filter element of the internal combustion engine 12 can be removed and replaced with a clean filter element during or after the emptying cycle. Fresh oil can then be introduced into the internal oil lubrication distribution passage system by activating the fresh oil supply 18 to allow flow to the internal combustion engine. A pump 30 may be energized to draw fresh motor oil from a receptacle 18 for discharge into the internal combustion engine through the oil filter element 34 into the internal oil lubrication distribution passage 46 system for accumulation in the oil pan reservoir 26 of the internal combustion engine 12. The fresh motor oil supply follows the same path as was done by the compressed air previously mentioned.

When an adequate amount of fresh motor oil has been delivered to the internal combustion engine by the pump 30 and as determined by the information provided to the oil exchange apparatus 10, the pump 30 is deenergized. The quick connect couplings 44 and 50 are then disconnected from the oil exchange apparatus 10. The internal combustion engine 12 is now ready for normal use with the oil filter element having been precharged with fresh oil into the engine components in oil passages in an oil pan prelubricated with fresh or filtered oil prior to starting the engine. The amount of fresh oil added can be recorded to the vehicle electronic module 80. Other information may also be stored in the vehicle electronic module, such as date, miles since previous oil change and the like.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. An apparatus configured and arranged for changing oil in an internal combustion engine having an engine block and an internal oil lubrication system, an oil filter and an oil reservoir, said oil filter having an inlet side and an outlet side, the apparatus comprising:

means for evacuating fluid from said oil filter into said oil reservoir;

means for removing fluid from said oil reservoir;

means for introducing fluid into said oil reservoir through said oil filter and internal oil lubrication system;

means for monitoring the position of the oil filter relative to the internal oil lubrication system, wherein the oil filter is in a connect position when the oil filter is securely positioned on the internal oil lubrication system and the oil filter is in a disconnect position when the oil filter is in a position other than securely positioned on the internal oil lubrication system; and means for deactivating the fluid introducing means when the oil filter is in a disconnect position, wherein said fluid removing means includes an oil exit port in fluid communication with said oil reservoir via internal passages and a drain line, said passages and said drain line each being configured and arranged for placement in said internal combustion engine.

2. The apparatus of claim 1, wherein said fluid introducing means includes an oil inlet port in fluid communication with the inlet side of the oil filter.

3. The apparatus of claim 1, further comprising:

means for monitoring an engine running condition of the internal combustion engine; and means for deactivating the fluid removing means when the internal combustion engine is in the engine running condition.

4. The apparatus of claim 3, wherein the monitoring means for an internal combustion engine running condition comprises a signal generated by an oil pressure sensor.

5. The apparatus of claim 4, wherein the apparatus is connected to an electronic module in communication with the internal combustion engine.

6. The apparatus of claim 5, wherein said fluid introducing means includes an oil inlet port in fluid communication with the inlet side of the oil filter.

7. The apparatus of claim 1, wherein the means for monitoring the oil filter position comprises a signal generated by a switch configured to be embedded in an oil filter mounting boss in the engine block.

8. The apparatus of claim 1, wherein the means for monitoring the oil filter position comprises a signal generated by a proximity switch configured to be installed on the engine block near the oil filter.

9. The apparatus of claim 1, wherein the vehicle is fitted with an electronic microchip which carries oil change information.

10. An apparatus configured and arranged for changing oil in an internal combustion engine having an internal oil lubrication system, an oil filter and an oil reservoir, said oil filter having an inlet side and an outlet side, the apparatus comprising:

an engine block;

means for evacuating fluid from said oil filter into said oil reservoir;

means for removing fluid from said oil reservoir;

means for introducing fluid into said oil reservoir through said oil filter and internal oil lubrication system;

means for monitoring the position of the oil filter relative to the internal oil lubrication system, wherein the oil filter is in a connect position when the oil filter is securely positioned on the internal oil lubrication system and the oil filter is in a disconnect position when the oil filter is in a position other than securely positioned on the internal oil lubrication system; and means for deactivating the fluid introducing means when the oil filter is in a disconnect position, wherein said fluid removing means includes an oil exit port in fluid communication with said oil reservoir via internal passages and a drain line, said passages and said drain line each being configured and arranged for placement in said internal combustion engine, wherein said fluid introducing means includes an oil inlet port in fluid communication with the inlet side of the oil filter, wherein said oil inlet port and oil exit port are placed into the engine block proximate the oil filter.

11. The apparatus of claim 10, wherein said oil filter is mounted on the engine block.

12. The apparatus of claim 10 wherein the drain line is directly connected from the oil exit port to the oil reservoir.

13. The apparatus of claim 12, wherein valve means are disposed in the drain line between the oil exit port and oil reservoir.

14. An apparatus configured and arranged for changing oil in an internal combustion engine having an internal oil lubrication system, an oil filter and an oil reservoir, said oil filter having an inlet side and an outlet side, the apparatus comprising:

an engine block;

means for evacuating fluid from said oil filter into said oil reservoir;

means for removing fluid from said oil reservoir;

means for introducing fluid into said oil reservoir through said oil filter and internal oil lubrication system;

means for monitoring the position of the oil filter relative to the internal oil lubrication system, wherein the oil filter is in a connect position when the oil filter is securely positioned on the internal oil lubrication system and the oil filter is in a disconnect position when the oil filter is in a position other than securely positioned on the internal oil lubrication system; and mean for deactivating the fluid introducing means when the oil filter is in a disconnect position, wherein said fluid removing means includes an oil exit port in fluid communication with said oil reservoir via internal passages and a drain line, said passages and said drain line each being configured and arranged for placement in said internal combustion engine;

means for monitoring an engine running condition of the internal combustion engine, wherein the monitoring means for an internal combustion engine running condition comprises a signal generated by an oil pressure sensor; and means for deactivating the fluid removing means when the internal combustion engine is in the engine running condition, wherein the apparatus is connected to an electronic module in communication with the internal combustion engine, wherein said fluid introducing means includes an oil inlet port in fluid communication with the inlet side of the oil filter, and wherein said oil inlet port and oil exit port are machined into the engine block proximate the oil filter.

15. A process for changing oil in an internal combustion engine having an engine block and an internal oil lubrication system, an oil filter and an oil reservoir, said oil filter having an inlet side and an outlet side, the process comprising he steps of:

evacuating fluid from said oil filter into said oil reservoir;

removing fluid from said oil reservoir;

introducing fluid into said oil reservoir through the oil filter and internal oil lubrication system;

monitoring for an oil filter disconnect position when the oil filter is not securely positioned on the internal oil lubrication system; and deactivating the introducing of fluid in response to the monitoring detecting that the oil filter is in an unsecured position.

16. The process of claim 15, further comprising the steps of:

monitoring an engine running condition of the internal combustion engine; and deactivating the removal of fluid when the internal combustion engine is in the engine running condition.

17. The process of claim 16, further comprising the steps of:

reading a vehicle electronic module for an amount of fluid to introduce into the oil reservoir; and introducing the amount of fluid into the oil reservoir.

18. The process of claim 17, further comprising the step of recording oil change data.

* * * * *